United States Patent [19]

Goodell et al.

[11] Patent Number: 4,668,536

[45] Date of Patent: May 26, 1987

[54] METHOD AND APPARATUS FOR COATING CORRUGATED BOARD

[75] Inventors: Eston B. Goodell, Lincoln Park; Bruce L. Dinda, St. Clair Shores, both of Mich.

[73] Assignee: Eagle-Picher Industries, Inc., Cincinnati, Ohio

[21] Appl. No.: 812,119

[22] Filed: Dec. 23, 1985

[51] Int. Cl.[4] ..... B05D 7/22; B05D 1/18; B05C 3/10

[52] U.S. Cl. ..... 427/235; 118/69; 118/56; 118/63; 118/423; 427/348; 427/442

[58] Field of Search ..... 118/63, 423, 69, 429, 118/56; 427/230, 235, 348, 346, 442

[56] References Cited

U.S. PATENT DOCUMENTS

| | | | |
|---|---|---|---|
| 1,536,801 | 5/1925 | LaBombarde | 493/329 |
| 2,282,898 | 5/1942 | Snader et al. | 427/235 |
| 3,236,680 | 2/1966 | Hnot | 118/423 X |
| 3,257,226 | 6/1966 | Thwaites | 118/101 X |
| 3,343,977 | 9/1967 | Gjesdal | 118/326 X |
| 3,635,193 | 1/1972 | Stease | 118/69 X |
| 3,793,056 | 2/1974 | Stease | 493/328 X |
| 4,184,449 | 1/1980 | Louderback | 118/63 |

*Primary Examiner*—John P. McIntosh
*Attorney, Agent, or Firm*—Wood, Herron & Evans

[57] ABSTRACT

Apparatus for applying a coating of paraffin wax to sheets of corrugated paperboard. The sheets are fed in a generally horizontal attitude through a bath of molten wax disposed in an elongated tank. Chain belt conveyors provide upper and lower flights to hold the sheets as they are passed through the bath.

10 Claims, 1 Drawing Figure

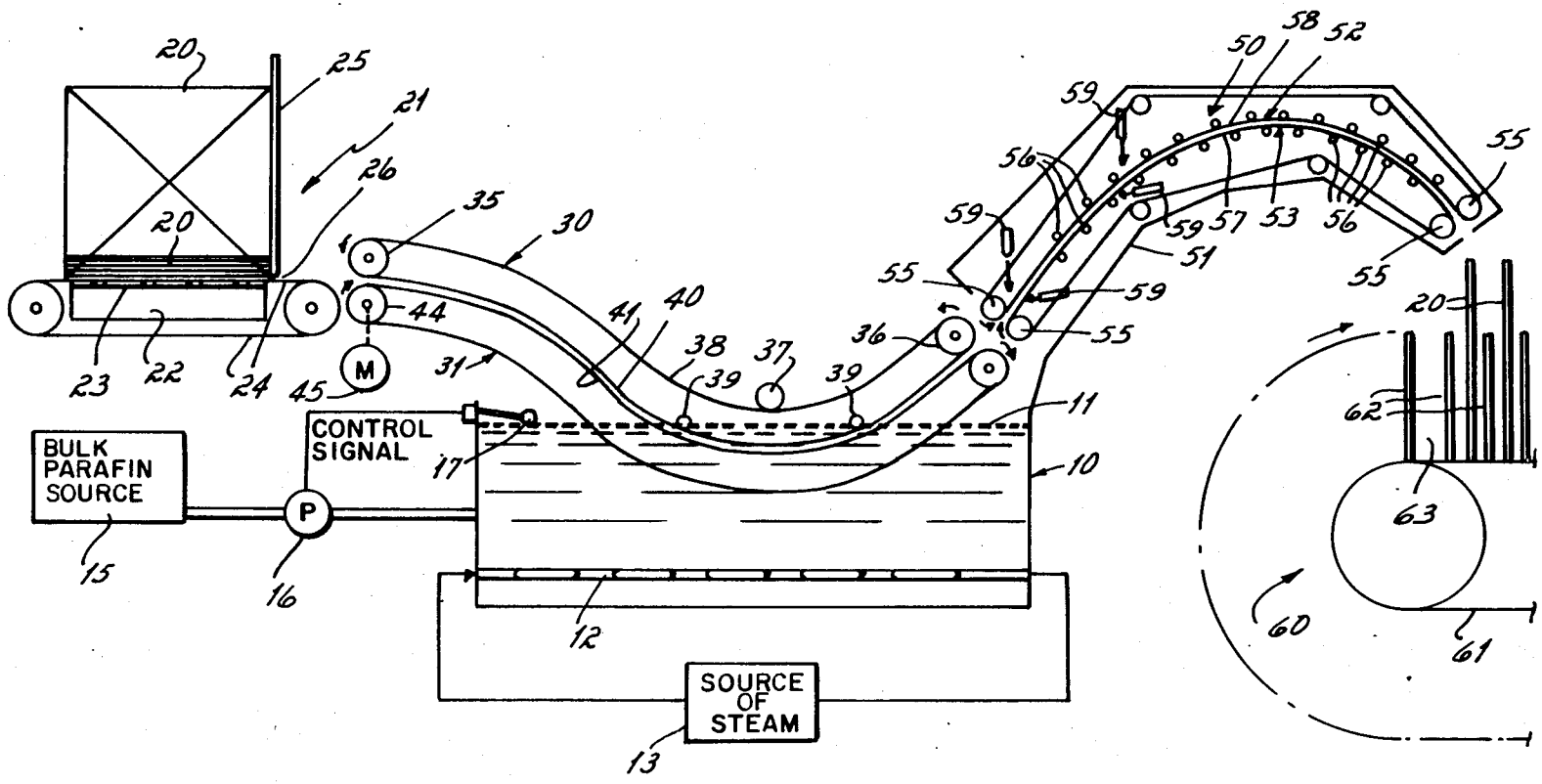
SOURCE OF STEAM
CONTROL SIGNAL
BULK PARAFIN SOURCE
M
P

METHOD AND APPARATUS FOR COATING CORRUGATED BOARD

This invention relates to a method and apparatus for coating corrugated paperboard with paraffin wax.

The corrugated paperboard to which the present invention is directed is a well known packaging material consisting of two parallel outer sheets having a corrugated web adhesively secured between the sheets to form a lightweight, rigid paperboard. The corrugated web creates, between the sheets, flutes which provide a considerable airspace between the parallel sheets.

A principal example of the use of wax-coated board is in the making of packages for shipping fresh fish. The fresh fish is deposited into a carton formed of wax-coated corrugated paperboard and ice is piled on top of the fish. In this condition, the fish is shipped to distant points for sale or further processing.

Wax-coated corrugated board has been used for this purpose. The conventional processes for coating corrugated board have resulted in corrugated board having about a four-hour life when subjected to contact with water. To retain fish for periods longer than about four hours, other packing methods must be considered.

The limited life of the board arises out of the process of coating it. The conventional processes involve the cutting of the board into the desired blanks, supporting the blanks in a vertical attitude with the flutes in a vertical orientation, and passing the blanks under a pouring curtain or bath of molten paraffin wax. This process does not form a complete coating internally of the board. The wax flows part-way down the airspaces created by the flutes and freezes, usually at the line created by scorelines or creases in the board. The solid paraffin blocks further passage of paraffin to coat the remainder of the flutes, thus leaving a portion of the board internally uncoated. In addition to providing a less than completely coated board, the buildup of wax can adversely affect the process of forming a carton from the blank. In bending the cartons at the scorelines, the buildup of wax causes the paper from which the board is made to rupture.

An objective of the present invention has been to provide a method and apparatus for thoroughly coating corrugated board.

This objective of the invention is achieved by providing a tank containing molten paraffin and a conveyor system for carrying board in the direction of the flutes substantially horizontally through the bath of molten paraffin wax. Further, the invention provides an inverted U-shaped drip conveyor which swings the coated board received from the tank vertically and carries it up past a blast of air which removes excess wax. Following the path of the inverted U-shaped conveyor, the board then is swung into a downward movement and dropped in a vertical attitude onto a conveyor which carries the board away from the drip conveyor. The final conveyor holds the board in a vertical attitude until the wax has chilled.

It is preferred to enclose the drip conveyor in a casing. The lower portion of the casing catches wax blown off the board and conveys it back into the tank. The casing tends to keep heat around the board, thus promoting the flow of excess wax off the board.

It is preferred to use paraffin wax of a low melting point, that is, about 130° F., to provide a more complete saturation of the board. It is also preferred to operate at between about 180° F. to 200° F.

The board produced in accordance with the invention has at least about 48 hours of life when subjected to water.

The several features and objectives of the present invention will become more readily apparent from the following detailed description taken in conjunction with the accompanying drawing which is a diagrammatic side-elevational view of the apparatus.

The single FIGURE of the drawing is a diagrammatic side-elevational view of the apparatus.

Referring to the drawing, an elongated tank 10 is provided. The tank contains molten paraffin wax indicated at 11. Wax is maintained at the desired temperature preferably between 180° F. and 200° F. by steam passing through a serpentine pattern of pipes 12, the steam coming from a source 13.

Paraffin is supplied to the tank 10 from a heated source 15 through a pump 16. A float 17 maintains the paraffin at the desired level.

The supplying of paraffin and the heating of the paraffin is performed by conventional apparatus used in the making of wax-coated paper.

Blank sheets 20 are first cut, creased and scored on conventional printer/slotter apparatus. The blanks are loaded onto a conventional feeder 21. The feeder has a vacuum box 22 having a perforated upper plate 23. A perforated, endless belt 24 passes over the vacuum box. The vacuum, transmitted to the belt 24, grasps sheets 20, one at a time, and drives them toward the tank 10. A barrier 25 is mounted substantially vertically at the downstream end of the feeder. The barrier 25 is spaced at 26 above the conveyor by an amount just sufficient to let one sheet pass from the feeder toward the tank.

At the tank are an upper endless chain belt 30 and a lower endless chain belt 31. The chain belts consist of conventional link chains at the sides of the belt, the link chains carrying a web of a flexible wire mesh, the mesh presenting openings about 1–2 inches square which permit the free flow of paraffin around the belts. The upper belt passes around an upstream drum 35 and a downstream drum 36. Each drum has sprockets at each end to engage the chain link at the sides of the belt. A central hold-down roll 37 engages an upper flight 38 of the upper belt 30. A pair of transversely, longitudinally-spaced hold-down rolls 39 engage the upper surface of a lower flight 40 of the upper belt.

The lower belt 31 has an upper flight 41 which passes closely adjacent the lower flight 40 of the upper belt to create a space between which sheets 20 are gripped and carried through the bath 11 of molten paraffin wax. The sheets are conveyed with the flutes oriented in the direction of travel so that paraffin tends to flow through the spaces defined by the flutes. In the excursion from the upstream end to the downstream end of the conveyor, the sheets, while having some vertical components of motion, are generally more substantially in a horizontal attitude.

A drive motor 45 is connected by a belt to the drum 44 of the lower belt 31. The drums at the downstream end of the belts are geared together so that the drive from the lower belt is transmitted to the upper belt.

At the downstream or discharge end of the belts 30, 31 is a drip conveyor 50. The drip conveyor has a housing 51 which supports upper endless belts 52 and lower endless belts 53. The belts are conventional V belts. Five upper belts, transversely spaced across the housing 51, are provided. Five lower belts, transversely-spaced across the housing 51, are also provided. The upper belts are laterally staggered with respect to the lower belts. All belts pass around pulleys 55 and are driven from the conveyor belts 30, 31.

Internal rollers 56 are provided to define the U-shaped path of the adjacent upper flights 57 and lower flights 58 of the upper and lower belts, respectively.

A plurality of nozzles 59 are provided to direct continuous blasts of air against both surfaces of the sheets 20 to blow the excess wax off the sheets. The wax will drip along the bottom of the casing 51 back into the tank 10.

At the downstream or discharge end of the drip conveyor is an off-take conveyor 60. The off-take conveyor is formed by a wide belt 61 to which transversely-spaced prongs 62 are mounted. The prongs are also longitudinally-spaced to provide compartments 63 into which individual sheets 20 may be dropped from the drip conveyor. The off-take conveyor is sufficiently long to permit the wax to chill. At the downstream end of the off-take conveyor, the sheets are piled horizontally onto pallets and carried away for shipment.

In the operation of the invention, sheets 20 are fed one at a time between the chain belts 30, 31. The sheets are clamped between the upper and lower flights 40, 41 and are completely submerged in the bath 11 contained in the tank 10. The sheets are then conveyed upwardly into the drip conveyor 50. There, as the sheets move upwardly, blasts of air blow excess wax off the sheets. The sheets are then rotated to a downward attitude and dropped onto the off-take conveyor 60 where the wax chills.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. Apparatus for applying a coating of wax to sheets of corrugated paperboard, each having two sheets of paper sandwiching a flute creating corrugated sheet therebetween comprising:

a tank, means for supplying wax to said tank, means for heating said wax, means for conveying said sheets, lying in substantially horizontal planes, through said tank in the direction of said flutes, means at the discharge end of said tank for draining said sheets, and means at the discharge end of said draining means for carrying said sheets in a vertical attitude away from said draining means to freeze said wax.

2. Apparatus as in claim 1 in which said conveying means comprises an upper chain belt having a lower flight, a lower chain belt having an upper flight adjacent said lower flight, and means for feeding said sheets between said adjacent flights.

3. Apparatus as in claim 2 further comprising, a pair of transverse longitudinally-spaced rollers mounted in said tank at about the level of said tank, said rollers holding the adjacent flights of said belts below the level of said wax.

4. Apparatus as in claim 2 further comprising, upper and lower drums supporting each end of said upper and lower belts, respectively, means for varying the longitudinal spacing of said drums to vary the length of said belts passing through said wax.

5. Apparatus as in claim 2 further comprising, a motor driving said upper belt, gears connecting said upper belt to said lower belt.

6. Apparatus as in claim 1 in which said draining means comprises a plurality of laterally-spaced upper endless belts having lower flights, a plurality of laterally-spaced lower belts having upper flights adjacent said lower flights, means forming an inverted U-shaped path for said upper and lower flights to convey sheets first upwardly away from said tank, then downwardly.

7. Apparatus as in claim 6 further comprising blowers adjacent said upper and lower flights to blow liquid wax off said sheets.

8. Apparatus as in claim 6 further comprising a casing surrounding at least the lower portion of said belts to capture melted wax and return it to said tank.

9. Apparatus as in claim 1 further comprising means for feeding said sheets to said conveying means in a direction parallel to said flutes.

10. The method of coating corrugated paperboard with wax comprising the steps of:

heating to a melted condition a bath of paraffin wax, conveying sheets of corrugated board in a horizontal attitude through said wax in the direction of the flutes of the board, conveying said sheets from said bath in an inverted U-shaped path, blowing excess wax from said board, returning said excess wax to said bath, and chilling the wax on said sheets.

* * * * *